US009493303B2

(12) United States Patent
Wurman et al.

(10) Patent No.: US 9,493,303 B2
(45) Date of Patent: Nov. 15, 2016

(54) SYSTEM AND METHOD FOR PROCESSING WASTE MATERIAL

(71) Applicant: Amazon Technologies, Inc., Reno, NV (US)

(72) Inventors: Peter R. Wurman, Acton, MA (US); Michael Barbehenn, Bedford, MA (US); Aron Klair Insinga, Nashua, NH (US); Eric Leventhal Arthen, Worthington, MA (US); Joshua B. Chaitin-Pollak, Salem, MA (US)

(73) Assignee: Amazon Technologies, Inc., Reno, NV (US)

( * ) Notice: Subject to any disclaimer, the term of this patent is extended or adjusted under 35 U.S.C. 154(b) by 208 days.

(21) Appl. No.: 14/308,433

(22) Filed: Jun. 18, 2014

(65) Prior Publication Data

US 2014/0303773 A1 Oct. 9, 2014

Related U.S. Application Data

(63) Continuation of application No. 12/766,492, filed on Apr. 23, 2010, now Pat. No. 8,798,786.

(60) Provisional application No. 61/289,890, filed on Dec. 23, 2009.

(51) Int. Cl.

| | |
|---|---|
| ***G06F 7/00*** | (2006.01) |
| ***B65F 3/00*** | (2006.01) |
| ***B65F 1/14*** | (2006.01) |

(52) U.S. Cl.

CPC ..... *B65F 3/00* (2013.01); *B65F 1/1452* (2013.01); *B65F 1/1473* (2013.01)

(58) Field of Classification Search

None

See application file for complete search history.

(56) References Cited

U.S. PATENT DOCUMENTS

| | | | | |
|---|---|---|---|---|
| 5,631,835 | A | 5/1997 | Hagenbuch | |
| 5,837,945 | A | 11/1998 | Cornwell et al. | |
| 2007/0290040 | A1* | 12/2007 | Wurman | B65G 1/137 235/385 |

(Continued)

FOREIGN PATENT DOCUMENTS

| | | |
|---|---|---|
| CN | 2007-1007676.2 | 8/2007 |
| DE | 4321754 | 6/1993 |

(Continued)

OTHER PUBLICATIONS

State Intellectual Property Office of the People's Republic of China, The Second Office Action (3 pages), and English Translation of Office Action (4 pages) for Application No. 201080064732.7., Jan. 13, 2015.

(Continued)

*Primary Examiner* — Yolanda Cumbess

(74) *Attorney, Agent, or Firm* — Baker Botts L.L.P.

(57) ABSTRACT

A method for processing waste in a material handling system includes detecting an occurrence of a trigger event associated with a waste holder located at a first location and, in response to detecting the trigger event, moving a mobile drive unit to the first location. The method also includes loading waste material onto the mobile drive unit at the first location and transporting the waste material to a waste station using the mobile drive unit.

19 Claims, 6 Drawing Sheets

(56) References Cited

U.S. PATENT DOCUMENTS

| | | | | |
|---|---|---|---|---|
| 2008/0167884 | A1* | 7/2008 | Mountz | G06Q 10/087 705/29 |
| 2009/0055239 | A1 | 2/2009 | Waitkus, Jr. | |
| 2009/0185884 | A1 | 7/2009 | Wurman et al. | |
| 2009/0261981 | A1* | 10/2009 | Jones | G06Q 10/06 340/666 |
| 2010/0119341 | A1* | 5/2010 | Flood | B65F 1/1484 414/406 |
| 2010/0217715 | A1* | 8/2010 | Lipcon | G06Q 10/00 705/308 |

FOREIGN PATENT DOCUMENTS

| | | |
|---|---|---|
| DE | 19856552 | 6/2000 |
| JP | 07-223705 | 8/1995 |
| JP | 07-233705 | 8/1995 |
| JP | 11292278 | 10/1999 |
| JP | 2001-84038 | 3/2001 |
| JP | 2009-541177 | 11/2009 |

OTHER PUBLICATIONS

International Search Report, International Application No. PCT/US2007/070739; 4 pages, Dated Mar. 31, 2015 recieved May 19, 2015.

Decision to Refuse; Patent Application No. 2012-545978 and English Translation; 6 pages, Dated Mar. 31, 2015 received May 19, 2015.

Canadian Intellectual Property Office Communication regarding Application No. 2,784,874 dated Sep. 17, 2013(received Oct. 8, 2013)..

State Intellectual Property Office of the People's Republic of China First Office Action (21 pages), and English Translation of Office Action (22 pages) for Application No. 2010-80064732.7, May 20, 2014.

Japanese Office Action (3 pages), and English Translation of Office Action (3 pages) for Application No. 2012-545978, dated May 27, 2014 but received Jul. 4, 2014.

Canadian Patent Office Communication for Appl. No. 2,868,578; 3 pages, Jun. 23, 2016 (mail date).

* cited by examiner

SYSTEM AND METHOD FOR PROCESSING WASTE MATERIAL

CROSS REFERENCE TO RELATED APPLICATIONS

This application is a continuation of U.S. patent application Ser. No. 12/766,492 entitled "System and Method for Processing Waste Material," filed Apr. 23, 2010 which claims priority to U.S. Provisional Patent Application Ser. No. 61/289,890, entitled "System and Method for Processing Waste Material," which was filed Dec. 23, 2009 which are hereby incorporated by reference.

RELATED APPLICATIONS

This application claims priority to U.S. Provisional Patent Application Ser. No. 61/289,890, entitled "SYSTEM AND METHOD FOR PROCESSING WASTE MATERIAL," which was filed on Dec. 23, 2009. U.S. Provisional Patent Application Ser. No. 61/289,890 is hereby incorporated by reference.

TECHNICAL FIELD OF THE DISCLOSURE

This disclosure relates, in general, to material handling systems and, more particularly, to a method and system for processing waste in a material handling system.

BACKGROUND OF THE INVENTION

Waste processing tasks, such as waste collection and disposal, can be critical to the effective operation of modern workplaces. For example, in sophisticated work environments that are configured to minimize worker downtime and maximize throughput, trash and other waste materials may accumulate quickly but the overall workplace efficiency may be significantly reduced if workers continually stop their assigned tasks to empty trash containers, deliver recyclable materials to a recycling center, or return defective components to a repair station. Furthermore, in material handling systems and other work environments in which machinery and automated devices may be moving or in operation, worker movement may create safety issues or impede the operation of the machinery and devices. However, in many types of workplaces, neglecting these waste processing tasks prevent workers from completing tasks and create other safety concerns. As a result, techniques and systems for efficiently processing waste may provide significant advantages in many types of work environments.

SUMMARY OF THE INVENTION

In accordance with the present invention, the disadvantages and problems associated with waste processing have been substantially reduced or eliminated. In particular, a material handling system is disclosed that provides improved techniques for processing waste.

In accordance with one embodiment of the present disclosure, a method for processing waste in a material handling system includes detecting an occurrence of a trigger event associated with a waste holder located at a first location and, in response to detecting the trigger event, moving a mobile drive unit to the first location. The method also includes loading waste material onto the mobile drive unit at the first location and transporting the waste material to a waste station using the mobile drive unit.

In accordance with another embodiment of the present disclosure, a material handling system includes a plurality of waste holders, a waste station, a plurality of mobile drive units, and a management module. The waste holders store waste material, and the waste station performs a waste processing task. Additionally, the plurality of mobile drive units are capable of transporting waste material stored by the waste holders to the waste station. The management module is capable of detecting an occurrence of a trigger event associated with a waste holder located at a first location and, in response to detecting the trigger event, selecting one of the plurality of mobile drive units. The management module is also capable of instructing the selected mobile drive unit to move to the first location and instructing the selected mobile drive unit to transport waste material from the first location to the waste station.

Technical advantages of certain embodiments of the present invention include a flexible, scalable waste-processing system. Additionally, particular embodiments may facilitate intelligent scheduling of waste-processing tasks and the optimized use of system resources for implementing such tasks. Particular embodiments of the present invention may provide waste processing less expensively and utilizing less space. Other technical advantages of the present invention will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1A:
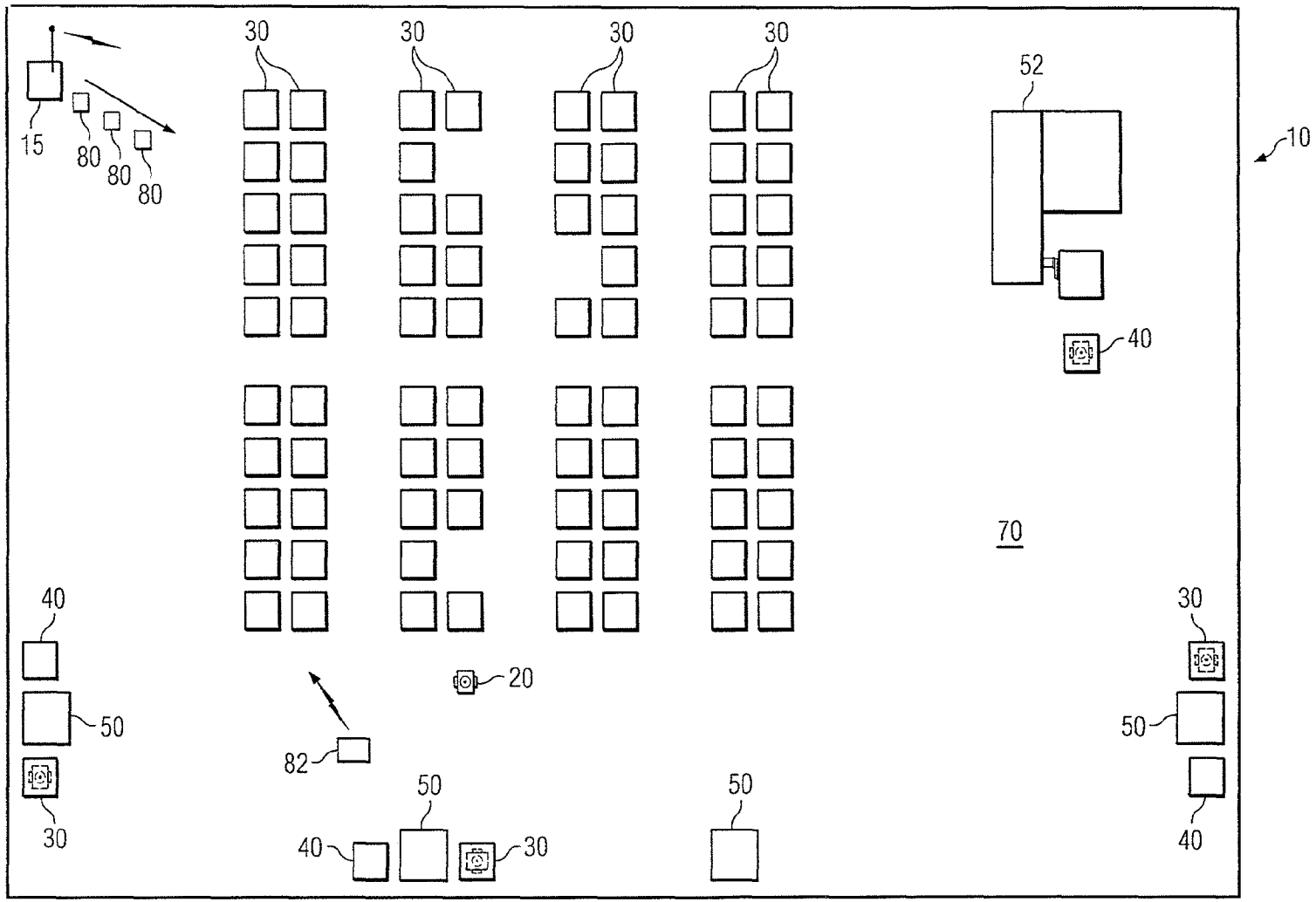
FIGS. 1A-1B show various views of a material handling system that supports improved waste-processing techniques.
Figure 1B:
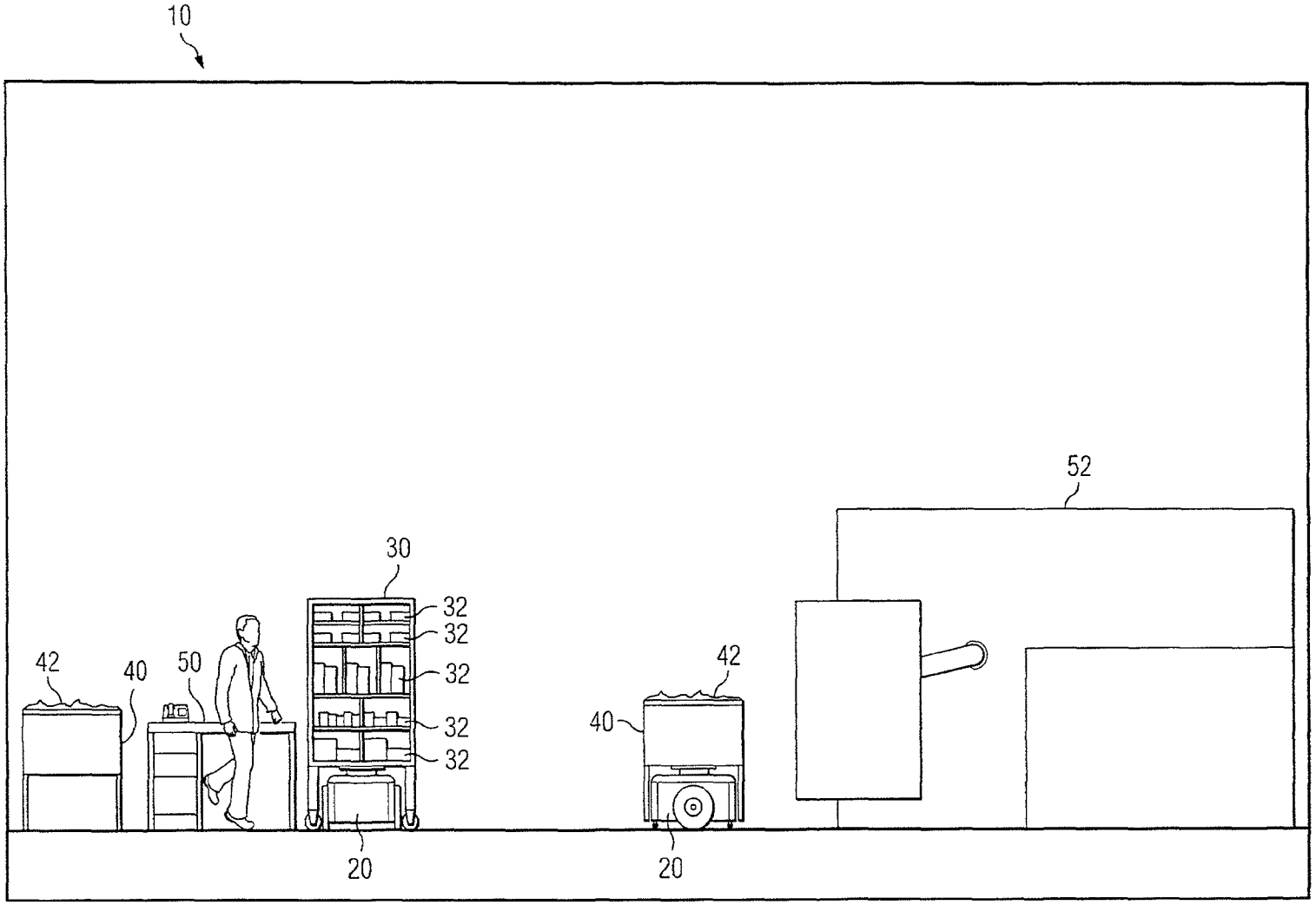

FIGS. 1A and 1B illustrate a top and side view, respectively, of a particular embodiment of a material handling system 10 that implements automated waste-processing techniques. Material handling system 10 includes a management module 15, one or more mobile drive units 20, one or more waste holders 40, one or more workstations 50, and one or more waste stations 52 that operate within a workspace 70. Work performed at workstations 50 generates waste material 42 that operators or automated components of workstations 50 deposit in waste holders 40. At appropriate times during operation, mobile drive units 20 transport waste material 42 to a waste station 52 or other appropriate locations within workspace 70 for processing of waste material 42. By intelligently managing this process, material handling system 10 may provide a flexible, optimized technique for disposing of or otherwise processing waste material 42 resulting from work performed in material handling system 10, as described further below.

Management module 15 manages the operation of mobile drive units 20, workstations 50, waste station 52, and/or other elements of material handling system 10 in completing tasks associated with material handling system 10. Management module 15 may select components to perform these tasks and communicate commands, instructions, and/or other appropriate information to the selected components to facilitate completion of these tasks. Management module 15 may represent a single component, multiple components located at a central location within material handling system 10, and/or multiple components distributed throughout material handling system 10. As one example, in embodiments of material handling system 10 that utilize centralized management, management module 15 may represent a PC or server capable of communicating with mobile drive units 20, workstations 50, and/or other elements of material handling system 10. As another example, in embodiments of material handling system 10 that utilize peer-to-peer management, management module 15 may represent a collection of components in mobile drive units 20 that are capable of communicating information between the mobile drive units 20 and coordinating movement of mobile drive units 20. In general, management module 15 may include any appropriate combination of hardware and/or software suitable to provide the described functionality and may further include components located on mobile drive units 20, workstations 50, or other elements of material handling system 10.

Mobile drive units 20 transport various materials associated with the tasks completed by material handling system 10 between locations within workspace 70. Mobile drive units 20 may represent any devices appropriate to transport the materials or components, such as inventory holders 30 and waste holders 40, that are to be moved around workspace 70. In particular embodiments of material handling system 10, mobile drive units 20 represent independent, self-powered devices configured to freely move about workspace 70. In alternative embodiments, mobile drive units 20 represent part of a tracked material handling system 10 and are configured to move along tracks, rails, cables, or other guidance elements traversing workspace 70. In general, mobile drive units 20 may be powered, controlled, and propelled in any manner appropriate based on the configuration and characteristics of material handling system 10.

In particular embodiments, the movement of mobile drive units 20 between locations within workspace 70 may be managed by management module 15. This may permit management module 15 to eliminate collisions between mobile drive units 20, reduce congestion within workspace 70, or otherwise optimize the transport of waste material 42 and other materials within workspace 70. As a result, mobile drive units 20 may receive navigational information from management module 15 when assigned tasks by management module 15 and/or may request such information as appropriate while completing tasks. Additionally, management module 15 may coordinate movement of mobile drive units 20 within workspace 70, and mobile drive units 20 may, when moving between locations, request use of a particular portion of workspace 70 before moving across that portion. For example, in particular embodiments, upon receiving a task assignment from management module 15, a mobile drive unit 20 will request from management module 15 a path to a destination associated with the assigned task. The mobile drive unit 20 may then interact with management module 15 as needed to iteratively reserve portions of that path, thereby allowing the mobile drive unit 20 to move from its current location to the destination.

Waste holders 40 hold waste material 42 resulting from various tasks completed in workspace 70. Waste holders 40 may include one or more containers in which waste material 42 may be deposited. Such containers may be fixed to waste holders 40, removable from waste holders 40, and/or disposable (e.g., trash bags). Additionally, in particular embodiments, waste holders 40 may include reconfigurable containers that can be re-sized based on the type of waste material 42 to be stored. Waste holders 40 may also include appropriate components or may otherwise be configured to allow mobile drive units 20 to dock with and/or carry waste holders 40 between locations within workspace 70. Waste holders 40 may also include doors or other components to enclose, secure, or isolate waste material 42. In general, waste holders 40 may have any appropriate structure and be configured to store waste material 42 in any suitable manner based on the type of waste material 42 stored by the relevant waste holders 40.

Waste material 42 represent garbage, recyclable material, malfunctioning or non-functional merchandise, and/or any other materials created or collected as a by-product of tasks completed in workspace 70. Although described, for purposes of simplicity, as "waste," waste material 42 may represent materials that are not intended for destruction or disposal, such as malfunctioning products collected for repair. Examples of waste material 42 in various embodiments of material handling system 10 include, but are not limited to, packaging removed from inventory items 32, personal trash generated by operators of workstations 50, defective components, and exhausted supply containers (e.g., discharged batteries and empty printer cartridges).

Although material handling system 10 may represent a system in which any particular materials are handled, FIGS. 1A and 1B illustrate, for purposes of example, an embodiment of material handling system 10 in which inventory items 32 are transported, processed, and stored. As a result, the illustrated embodiment includes multiple inventory holders 30 that store inventory items 32. Inventory holders 30 may include multiple storage bins with each storage bin capable of holding a different type of inventory item 32. Inventory holders 30 are capable of being carried, rolled, or otherwise moved by mobile drive units 20 between locations within workspace 70.

Inventory items 32 represent any objects suitable for storage, retrieval, and/or processing in an automated material handling system 10. As one example, material handling system 10 may represent a mail-order warehouse facility, and inventory items 32 may represent merchandise stored in the warehouse facility. During operation, mobile drive units 20 may retrieve inventory holders 30 containing one or more inventory items 32 to be packed for delivery to a customer. As another example, material handling system 10 may represent a merchandise-return facility, and inventory items 32 may represent merchandise returned by customers. During operation, these inventory items 32 are received at the facility and stored in inventory holders 30 and, at appropriate times, may be removed from inventory holders 30 for shipment back to a warehouse or other facility. As yet another example, material handling system 10 may represent a manufacturing facility with inventory items 32 representing individual components of a manufacturing kit to be included in an assembled product, such as electronic components for a customized computer system. During operation, inventory items 32 may be retrieved from storage and delivered to workstations 50 where they are assembled into finished products.

Workstations 50 represent locations designated for the completion of certain tasks. As noted above, the illustrated embodiment of material handling system 10 represents an inventory system, and thus in the illustrated embodiment, these tasks may include fulfilling orders using inventory items 32, packaging orders that contain inventory items 32, storing inventory items 32 in inventory holders 30, inspecting inventory items 32, and/or processing or handling inventory items 32 in any other suitable manner. Workstations 50 may also represent or include any appropriate components for completing the corresponding tasks, such as scanners for monitoring the flow of materials (such as inventory items 32) in and out of material handling system 10, communication interfaces for communicating with management module 15, and/or any other suitable components. Workstations 50 may be controlled, entirely or in part, by human operators or may be fully automated.

Figure 3A:
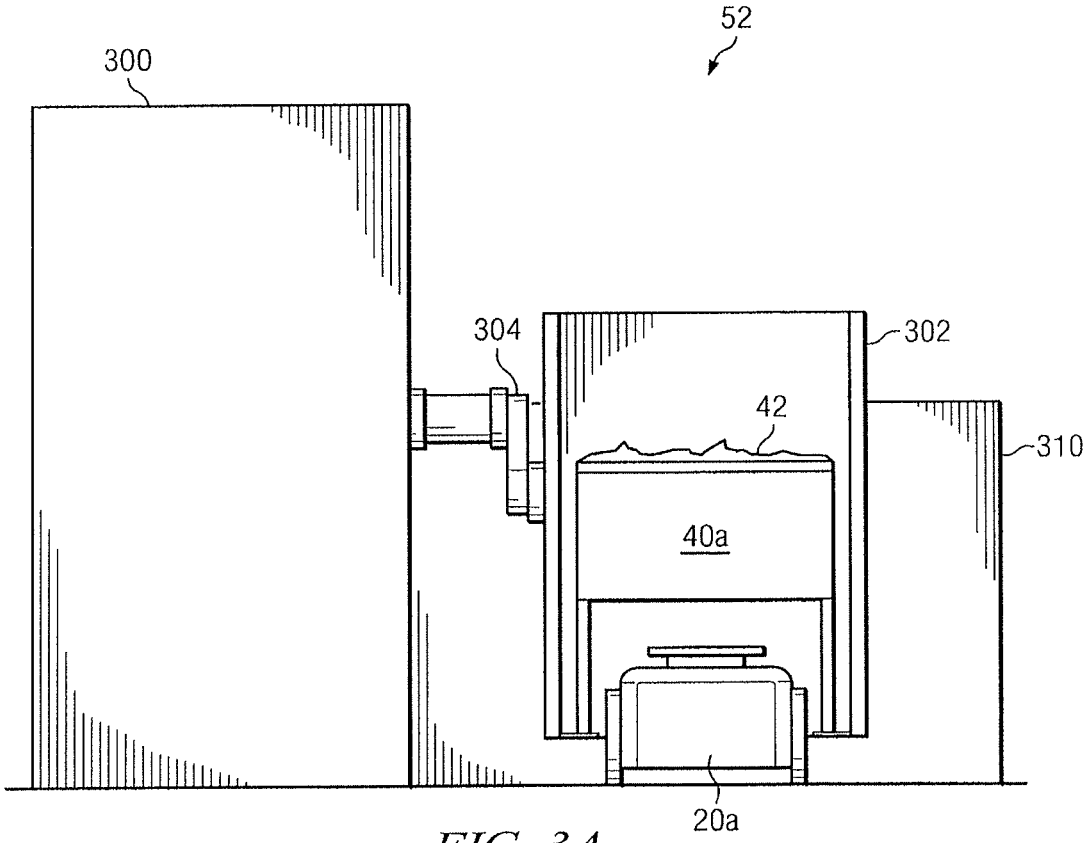
FIGS. 3A-3B illustrate a waste station that may be utilized in particular embodiments of the material handling system.
Figure 3B:
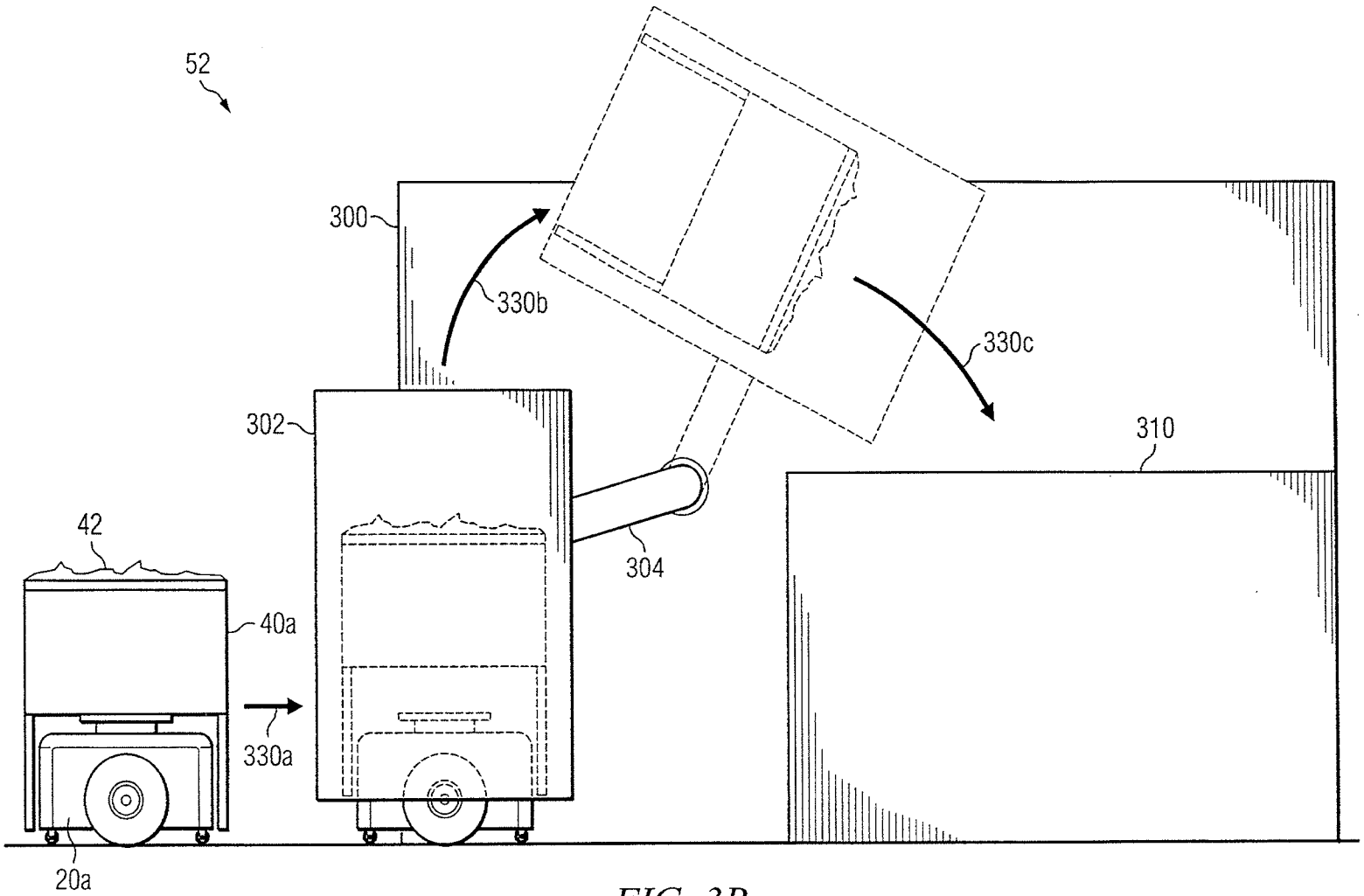

Waste station 52 represent a location in workspace 70 in which certain waste material 42 generated during the operation of material handling system 10 is stored, destroyed, recycled, sorted, converted, removed from workspace 70, or otherwise processed. For example, waste station 52 may represent a bin in which trash collected from various locations is stored, machinery where packaging removed from inventory items 32 is recycled, loading docks where refuse is removed from workspace 70, a table or other surface on which waste material 42 is deposited for manual sorting, and/or any other location at which tasks involving waste material 42 are completed. Waste stations 52 may also represent any appropriate components for processing or handling inventory items 32, For example, waste stations 52 may represent or include bins, incinerators, compactors, recycling equipment, bailers, sorters, and/or any other appropriate equipment for processing waste material 42. Waste stations 52 may also represent or include conveyors, chutes, carousels, or other mechanisms configured to deliver waste material 42 to waste-processing equipment. In particular embodiments, waste station 52 may be associated with a particular type of waste material 42. In such embodiments, a particular type of waste material 42 is preferably processed at an associated waste station 52. For example, a particular waste station 52 may process cardboard waste material 42 for recycling. Any cardboard waste material 52 generated at workstation 50 is delivered to the waste station 52 that processes cardboard. As another example, a particular waste station 52 may process hazardous waste material 52. Any hazardous waste material 52 generated by workstation 50 is delivered to the waste station 52 that processes hazardous waste. Waste stations 52 may be controlled, entirely or in part, by human operators or may be fully automated. FIGS. 3A and 3B show an example of a waste station 52 that may be utilized in particular embodiments of material handling system 10. Although FIGS. 1A and 1B show an embodiment of material handling system 10 that includes only a single waste station 52, material handling system 10 may include any number of waste stations 52.

Workspace 70 represents an area associated with material handling system 10 in which mobile drive units 20 can move and/or tasks may be completed by the various components of material handling system 10. For example, workspace 70 may represent all or part of the floor of a mail-order warehouse in which material handling system 10 operates. Although FIGS. 1A and 1B show, for the purposes of illustration, an embodiment of material handling system 10 in which workspace 70 includes a fixed, predetermined, and finite physical space, particular embodiments of material handling system 10 may include mobile drive units 20 that are configured to operate within a workspace 70 that is of variable dimensions and/or arbitrary geometry.

In operation, the various components of material handling system 10 cooperate to facilitate the completion of certain tasks at workstations 50. Management module 15 manages the operation of components and the use of various system resources to facilitate the fulfillment of these tasks. In particular embodiments, management module 15 may select components of material handling system 10, such as mobile drive units 20, inventory holders 30, and workstations 50, to complete the various tasks. Management module 15 may initiate completion of such tasks on a predetermined schedule, in response to requests received by material handling system 10, or based on any appropriate considerations or factors.

After management module 15 selects suitable components and/or elements to complete a particular task, management module 15 may then communicate information to the selected components indicating the task to be completed by these components or their operators and/or identifying one or more of the other selected components involved in completion of the requested operation. For example, in the illustrated embodiment, management module 15 communicates task requests 80 to selected components to communicate information regarding tasks to be completed by the receiving components and/or other components to be involved in completing the relevant tasks. Task requests 80 may represent communication of any suitable form to initiate completion of tasks by the receiving components, such as instructions, commands, and/or requests appropriately formatted for the receiving components.

The selected components may then utilize the received information to complete tasks associated with the relevant task request 80. For example, in the illustrated embodiment of material handling system 10, a selected mobile drive unit 20 may move a selected inventory holder 30 to a selected workstation 50 based on instructions received from management module 15. At the selected workstation 50, an operator may pick requested inventory items 32 from the selected inventory holder 30 based on information received from management module 15 and pack the picked inventory items 32 for shipment. The packed orders may then be transported to a loading dock for delivery to customers.

In the process of completing the tasks carried out by the relevant embodiment of material handling system 10, workers or equipment may create, extract, or separate waste material 42. As waste material 42 accrues within workspace 70, management module 15 may initiate certain waste-processing operations. Management module 15 may initiate these waste-processing operations according to certain predetermined schedules, in response to certain events, or based on any appropriate consideration or factor. As part of initiating and managing these waste-processing operations, management module 15 may select components such as mobile drive units 20, waste holders 40, and waste stations 52, and instruct the selected components to complete tasks related to processing waste material 42.

In the illustrated embodiment, management module 15 transmits a task request 80 to the selected mobile drive unit 20 to initiate completion of the relevant waste-processing task. Task request 80 may represent one or more messages, files, or executable instructions, and/or information structured in any other appropriate manner to instruct the selected mobile drive unit 20 to move to a particular location in workspace 70 where waste material 42 is being stored. Task request 80 may indicate a location in workspace 70, a workstation 50 or particular one or more waste holders 40 from which waste material 42 is to be collected, or other information permitting mobile drive unit 20 to determine a location or locations at which to collect waste material 42.

The selected mobile drive unit 20 may then move to the relevant location and transport waste material 42 from this location to waste station 52. For example, in particular embodiments, task request 80 identifies the location of one or more waste holders 40. Upon receiving task request 80, the selected mobile drive unit 20 moves to the identified location and transports waste material 42 from that location to waste station 52. In particular embodiments, this process may include the selected mobile drive unit 20 coupling to, lifting, or otherwise docking with the one or more waste holders 40 to permit the mobile drive unit 20 to move the one or more waste holders 40 to the appropriate waste station 52. In alternative embodiments, this process may include waste material 42 from the relevant one or more waste holders 40 being transferred from the relevant one or more waste holders 40 onto the selected mobile drive unit 20 or separate one or more waste holders 40 being transported by the selected mobile drive unit 20. In such embodiments, waste material 42 may be transferred by a human operator or by automated components. After waste material 42 is loaded onto the selected mobile drive unit 20 in an appropriate manner, the selected mobile drive unit 20 transports the loaded waste material 42 to waste station 52.

In particular embodiments, material handling system 10 may include multiple waste stations 52, and management module 15 may perform schedule optimizing or load balancing to appropriately assign waste-processing tasks to waste stations 52. As one example, upon deciding to initiate a waste-processing task, management module 15 may select a particular waste station 52 at which the relevant waste-processing task will be completed based on a distance between the selected waste station 52 and other relevant components, such as a workstation 50 from which waste material 42 is being collected. As another example, in particular embodiments, management module 15 may select a particular waste station 52 for completing the waste-processing task based on the number of waste holders 40 already waiting to be processed by that waste station 52.

In some embodiments, waste station 52 may process a selected type or types of waste material 42. As an example, in particular embodiments a particular waste station 52 may process hazardous waste material 42, and another waste station 52 may process glass waste material 42. Another waste station 52 may process plastic waste material 42. When hazardous waste material 42 accumulates at a particular workstation 52, management module 15 selects a waste station 52 that processes hazardous material to perform waste-processing tasks. When glass waste material 42 accumulates at a particular workstation 52, management module 15 selects a waste station 52 that processes glass waste material 42. Management module 15 may thus select an appropriate waste station 52 to process waste material 42 based on the type of waste material 42

At waste station 52, waste material 42 is unloaded from the selected mobile drive unit 20 and/or its transported one or more waste holders 40. Mobile drive unit 20 may then begin fulfilling other tasks, such as collecting other waste material 42 from other locations or transporting inventory holders 30 to and from workstations 50. If the selected mobile drive unit 20 transported one or more waste holders 40 to waste station 52 as part of fulfilling the relevant waste-processing task, management module 15 may instruct the selected mobile drive unit 20 to return the empty one or more waste holders 40 to a workstation 50 or other location within workspace 70. In particular embodiments, management module 15 may prioritize the assignment of empty waste holders 40 to workstations 50 based on a station/user priority associated with a particular workstation 50 (for example, workers completing certain tasks may get priority over other workers) or based on how long a particular workstation 50 has been waiting for an empty waste holder 40.

Alternatively, management module 15 may instruct the selected mobile drive unit 20 to transport the relevant one or more waste holders 40 to a waiting area where empty waste holders 40 are stored until needed. In particular embodiments, the number of waste holders 40 available for use in workspace 70 may exceed the number of waste holders 40 utilized at any given time. As a result, management module 15 may store empty waste holders 40 in a particular location in workspace 70 for subsequent assignment within workspace 70. Therefore, management module 15 may instruct a mobile drive unit 20 to deliver one of these empty waste holders 40 to a workstation 50 whenever a waste holder 40 is collected from that workstation 50. The location of this storage area may be predetermined or dynamically determined during operation of material handling system 10.

As noted above, management module 15 may initiate waste-processing tasks based on any appropriate considerations or factors. In particular embodiments, management module 15 may instruct mobile drive units 20 to collect waste material 42 according to a predetermined schedule. For example, management module 15 may initiate collection from all workstations 50 at the end of every work shift to ensure that workers begin each shift with an empty waste holder 40. Alternatively, management module 15 may initiate collection from the various workstations 50 according to a staggered schedule that reduces congestion at waste station 52.

In particular embodiments, waste-processing operations may be initiated in response to requests from users. For example, a worker operating a workstation 50 may request a waste holder 40 for that workstation 50 be removed when it is full by transmitting a waste request 82 to management module 15. Waste request 82 may represent a message, file, instruction, and/or information structured in any other appropriate manner to request collection of waste material 42 from the associated workstation 50. In such embodiments, waste requests 82 may be queued and fulfilled when a waste station 52 and/or a mobile drive unit 20 is available to fulfill such waste requests 82. In particular embodiments, management module 15 may delay retrieving a waste holder 40 from a requesting workstation 50 until its waste holder 40 can be delivered directly to and processed by an available waste station 52 without waiting. This may minimize the amount of time a particular workstation 50 is without a waste holder 40. Similarly, in particular embodiments, management module 15 may delay fulfilling waste requests 82 while waste stations 52 are offline or in an error state.

Furthermore, in particular embodiments, management module 15 may prioritize waste-processing operations for certain workers or workstations 50. For example, workstations 50 at which critical tasks are being performed, workstations 50 that produce excessive waste, or workstations 50 that produce hazardous or unsanitary waste may receive priority in task scheduling. Management module 15 may also schedule waste-processing operations for particular workers or workstations 50 based on an amount of work completed by that worker or workstation 50. In particular embodiments, management module 15 may estimate the amount of waste material 42 produced based on productivity of the worker or workstation 50. Additionally, in particular embodiments, sensors on waste holder 40 or at workstations 50 may determine an amount of waste material 42 accumulated in a waste holder 40 and management module 15 may use this information to schedule waste-processing tasks. Sensors on waste station 52 may also determine an amount of waste material 42 accumulated in a waste holder 40. Management module 15 may use the information determined by sensors at waste station 52 to schedule waste-processing tasks. For example, based on the determination by waste station 52 of the amount of waste material 42 accumulated in a waste holder 40 and/or a plurality of waste holders 40, management module 15 may wait to turn on a conveyor and baler until a predetermined and/or configurable amount of waste material 42 has been dumped from one or more waste holders 42. Additionally, some embodiments include a workstation 50 that determines an accumulated amount of waste material 42 in a relevant waste holder 40 prior to the relevant waste holder 40 being unloaded at waste station 52.

In particular embodiments, management module 15 may also learn waste-processing patterns and optimize the scheduling of waste-related tasks. For example, management module 15 may accept waste requests 82 from operators during a first period and then attempt to anticipate requests in a second period. As another example, waste requests from individual worker may be audited, and management module 15 may learn to ignore or de-prioritize requests from workers that have shown an inclination to request collection prematurely.

Management module 15 may schedule waste-processing tasks based on the location of involved workstations 50. This may allow management module 15 to optimize route planning of mobile drive units 20 involved in completing these tasks. For example, in particular embodiments, a mobile drive unit 20 may move from one workstation 50 to another collecting waste material 42, and management module 15 may schedule collection from workstations 50 in a particular order that minimizes or reduces the amount of time needed for the selected mobile drive unit 20 to visit each workstation 50.

Thus, techniques implemented by particular embodiments of material handling system 10 can provide a flexible, dynamic system for waste processing. These techniques may eliminate fixed transport systems dedicated to waste processing and may permit material handling system 10 to utilize certain components, such as mobile drive units 20, in both waste processing and other tasks completed by material handling system 10. Additionally, these techniques may optimize the timing of waste processing tasks completed by material handling system 10. Furthermore, these techniques may reduce the space requirements and expense of the waste-processing equipment used by particular embodiments of material handling system 10. While specific advantages have been enumerated above, various embodiments may include all, some, or none of the enumerated advantages.

Figure 2:
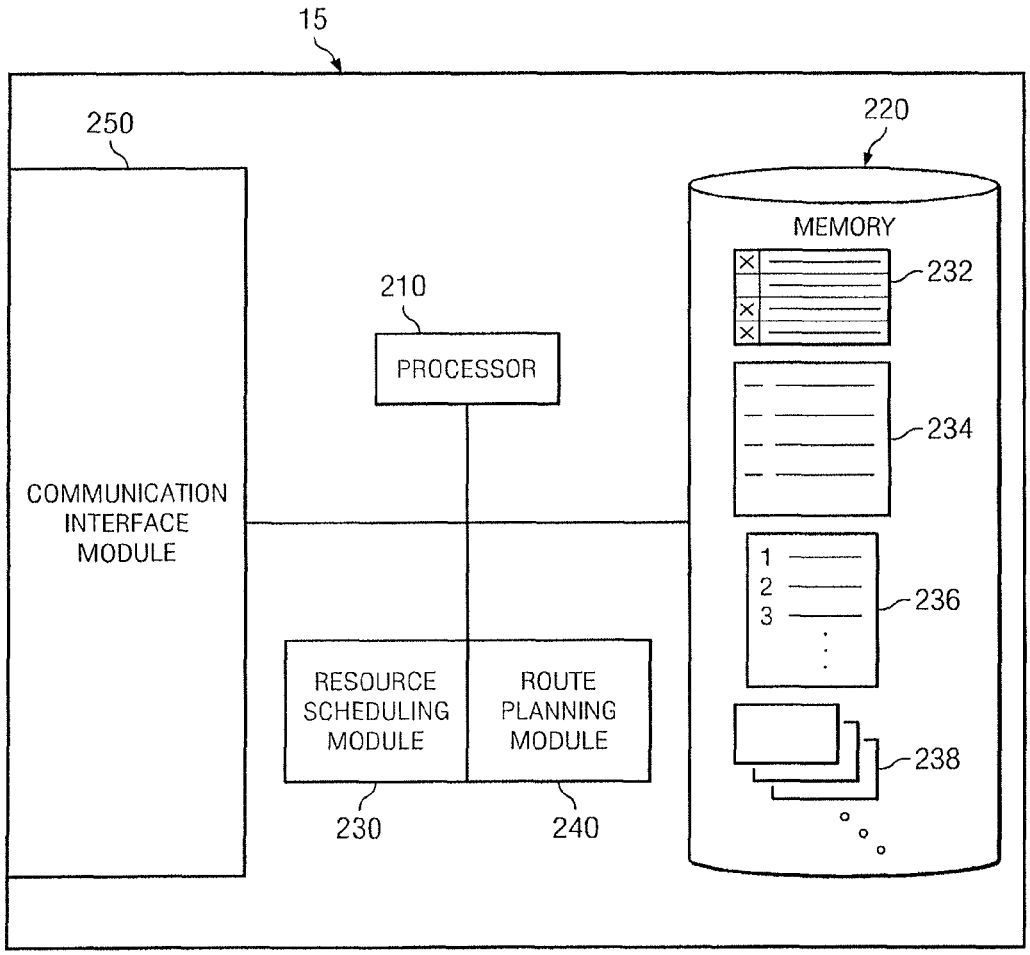
FIG. 2 is a block diagram of a particular embodiment of a management module that may be utilized in the material handling system of FIGS. 1A-1B.

FIG. 2 illustrates in greater detail the components of a particular embodiment of management module 15. As shown, the example embodiment includes a processor 210, a memory 220, a resource scheduling module 230, a route planning module 240, and a communication interface module 250. As noted above, management module 15 may represent a single component, multiple components located at a central location within material handling system 10, or multiple components distributed throughout material handling system 10. In general, management module 15 may include any appropriate combination of hardware and/or software suitable to provide the described functionality.

Processor 210 is operable to execute instructions associated with the functionality provided by management module 15. Processor 210 may comprise one or more general purpose computers, dedicated microprocessors, or other processing devices capable of communicating electronic information. Examples of processor 210 include one or more application-specific integrated circuits (ASICs), field-programmable gate arrays (FPGAs), digital signal processors (DSPs) and any other suitable specific or general purpose processors.

Memory 220 stores processor instructions, inventory requests, reservation information, state information for the various components of material handling system 10, and/or any other appropriate values, parameters, or information utilized by management module 15 during operation. Memory 220 may represent any collection and arrangement of volatile or non-volatile, local or remote devices suitable for storing data. Examples of memory 220 include, but are not limited to, random access memory (RAM) devices, read-only memory (ROM) devices, magnetic storage devices, optical storage devices, and any other suitable data storage devices.

Resource scheduling module 230 monitors operation of material handling system 10 and identifies appropriate tasks to be completed by components of material handling system 10 (including various tasks relating to waste processing within material handling system 10). As part of this process, resource scheduling module 230 may be responsible for selecting one or more appropriate components to complete tasks and, using communication interface module 250, communicate to the selected components information to be used in completing the tasks. Additionally, in particular embodiments, resource scheduling module 230 may maintain information indicating the availability or other properties of the various components of material handling system 10. For example, resource scheduling module 230 may maintain an assignment table 232 indicating which components currently have tasks assigned to them and may update assignment table 232 to reflect the new status of a particular component after selecting that component to complete a task.

Additionally, in particular embodiments, management module 15 may store policies, rules, or other information in memory 220 that resource scheduling module 230 may utilize in determining which waste-processing tasks to initiate and selecting appropriate times for initiating such tasks. As examples of information that resource scheduling module 230 may utilize, the illustrated embodiment of management module 15 includes a schedule 234, a priority list 236, and historical data 238 stored in memory 220. Alternative embodiments may utilize some, none, or all of this information.

Schedule 234 identifies times at which resource scheduling module 230 should collect waste material 42 from one or more workstations 50. In particular embodiments, schedule 234 may identify start times for workstations 50. These start times may indicate when resource scheduling module 230 should dispatch a mobile drive unit 20 to collect waste material 42 from a particular workstation 50, a particular group of workstations 50, or all workstations 50. The dispatched mobile drive unit 20 may then visit each of the corresponding workstations 50 to collect waste material 42 from a waste holder 40 located at each of these workstations 50. For example, schedule 234 may identify a start time for all workstations at which a particular task, such as order packing, is carried out and, at the designated start time, resource scheduling module 230 may dispatch a mobile drive unit 20 to visit these workstations 50 to collect waste material 42. In such embodiments, the dispatched mobile drive unit 20 may, depending on the configuration of material handling system 10, visit waste station 52 after each workstation 50, only after visiting all of the associated workstations 50, or as needed based on the amount of waste material 42 collected and/or other appropriate considerations.

Priority list 236 includes appropriate information indicating a priority associated with various locations, components, or workers within material handling system 10 for purposes of waste collection or other waste processing tasks. For example, priority list 236 may indicate in any appropriate fashion that certain workstations 50 (e.g., those associated with tasks that produce large amounts of waste material 42) should receive higher priority when scheduling waste collection. As a result, resource scheduling module 230 may determine when to schedule waste processing tasks for certain locations, components, or workers based on the priority associated with them and/or with other locations, components, or workers.

Historical data 238 provides information regarding waste generation, waste collection, waste-processing tasks, and other waste-related events that occurred previously in material handling system 10. Management module 15 may monitor various waste-related aspects of the operation of material handling system 10 and store historical data 238 generated based on this monitoring in memory 220. Resource scheduling module 230 may then determine, based on historical data 238, when to initiate waste-processing tasks or what type of waste-processing tasks to initiate.

As one example, management module 15 may measure the amount of waste material 42 stored in a waste holder 40 at a particular location at various times and generate historical data 238 indicating the typical rate at which waste material 42 will accumulate in that waste holder 40. Resource scheduling module 230 may then dispatch mobile drive units 20 to collect waste material 42 from that location based on such historical data 238. As another example, management module 15 may monitor the habits of individual users in requesting collection of waste material 42 from their workstation 50 and generate historical data 238 reflecting these habits. Based on such historical data 238, resource scheduling module 230 may attempt to anticipate when a particular user will request collection and dispatch an mobile drive unit 20 to collect waste material 42 from a waste holder 40 associated with the worker. Additionally, if management module 15 determines that a particular worker often requests collection long before optimal (e.g., based on a measure of how full the relevant worker's waste holder 40 is when the worker typically requests collection), historical data 238 may also include information indicating this. As a result, based on such historical data 238, resource scheduling module 230 may ignore, delay, or de-prioritize requests from the relevant worker. More generally, management module 15 may generate any useful historical data 238 based on the operation of material handling system 10, and resource scheduling module 230 may utilize such historical data 238 in any appropriate fashion to determine when to initiate waste-processing tasks and what type of tasks to initiate.

Route planning module 240 determines paths that mobile drive units 20 may follow to move between locations within workspace 70. Route planning module 240 may implement algorithms utilizing any appropriate parameters, factors, and/or considerations to determine the appropriate paths. For example, route planning module 240 may consider current or anticipated congestion within workspace 70, the status of certain locations within workspace 70 (e.g., whether certain locations are reserved for storage or other uses that prevent mobile drive units 20 from traversing them), the priority of the task associated with the path being generated, or any other suitable considerations when generating paths for mobile drive units 20. After generating an appropriate path, route planning module 240 may transmit information identifying the generated path to the relevant mobile drive unit 20 using communication interface module 250.

Communication interface module 250 facilitates communication between management module 15 and other components of material handling system 10 including, in particular embodiments, the exchange of task requests 80, waste requests 82, and navigational information. This communication may occur in any appropriate manner based on the capabilities of management module 15 and may include any suitable information. Depending on the configuration of management module 15, communication interface module 250 may be responsible for facilitating either or both of wired and wireless communication between management module 15 and the various components of material handling system 10. In particular embodiments, management module 15 may communicate using communication protocols such as 802.11, Bluetooth, or Infrared Data Association (IrDA) standards. Furthermore, as noted above, management module 15 may, in particular embodiments, represent a portion of mobile drive unit 20 or other components of material handling system 10. In such embodiments, communication interface module 250 may facilitate communication between management module 15 and other parts of the same system component.

In general, resource scheduling module 230, route planning module 240, and communication interface module 250 may each represent any hardware and/or software suitable to provide the described functionality. Moreover, any two or more of resource scheduling module 230, route planning module 240, and communication interface module 250 may share common components. For example, in particular embodiments, resource scheduling module 230 and route planning module 240 represent, in part or in whole, computer processes executing on processor 210 and communication interface module 250 comprises a wireless transmitter, a wireless receiver, and a related computer process executing on processor 210.

FIGS. 3A and 3B show a front and side view, respectively, of one type of waste station 52 that may be utilized in particular embodiments of material handling system 10. The illustrated waste station 52 includes an unloading assembly 300 to unload waste material 42 from mobile drive units 20 and a waste bin 310 into which waste material 42 from waste holders 40 is dumped. Although a particular type of waste station 52 is shown in FIGS. 3A and 3B, for purposes of example, waste station 52 may represent any location and/or components designated for processing waste material 42.

Unloading assembly 300 represents any element or elements capable of interacting with waste holders 40 transported to waste station 52 to facilitate unloading of waste material 42 from these waste holders 40. In the illustrated embodiment, unloading assembly 300 includes a carriage

302 capable of supporting waste holders 40 and an arm 304 capable of lifting the supported waste holder 40. In particular embodiments, waste stations 52 may be configured to process multiple different waste holders 40 simultaneously with a carriage 302 that accommodates multiple waste holders 40 for simultaneous lifting and dumping or with multiple carriages 302. Alternative embodiments of waste station 52 may include alternative types of unloading assemblies 300 suitable for unloading waste material 42 from other types of waste holders 40 or for unloading other types of waste material 42. For example, in particular embodiments, unloading assemblies 300 may include components such as a hose for draining liquid waste material 42 from waste holders 40, a scoop for lifting waste material 42 out of waste holders 40, and/or an overhead vacuum hose to suction waste material 42 out of waste holders 40.

Waste bin 310 is a receptacle into which waste material 42 from waste holders 40 is deposited. In particular embodiments, waste bin 310 may represent or connect to a compactor, composter, incinerator, sewage system, or other mechanism for removing or destroying waste material 42 or for converting waste material 42 into a form more easily stored or disposed of. More generally, however, waste bin 310 may represent any receptacle in which waste material 42 from waste holders 40 can be deposited.

When the illustrated embodiment of waste station 52 is in operation, unloading assembly 300 lifts waste holders 40 from their transporting mobile drive units 20 and dumps their contents into waste bin 310. To illustrate, FIGS. 3A and 3B show an example in which waste station 52 dumps waste material 42 from waste holder 40*a* into waste bin 310. As part of this example process, mobile drive unit 20*a* positions waste holder 40*a* partially or completely within carriage 302, as indicated by arrow 330*a*. Arm 304 raises carriage 302 thereby lifting waste holder 40 from mobile drive unit 20*a*. As indicated by arrow 330*b*, waste holder 40*a* is rotated by the movement of carriage 302 so that waste material 42 stored in waste holder 40*a* falls through an opening on top of waste holder 40. As a result, waste material 42 stored in waste holder 40*a* is dumped into waste bin 310, as indicated by arrow 330*c*. Arm 304 then lowers carriage 302 and deposits waste holder 40*a* back onto mobile drive unit 20*a* or another mobile drive unit 20 located at waste station 52. In some embodiments, arm 304 may lower carriage 302 and deposit waste holder 40*a* onto the floor of workspace 70 where it may be retrieved and/or transported by mobile drive unit 20*a* or another mobile drive unit 20 at a later time.

In particular embodiments, the relevant mobile drive unit 20 may configure itself to accept waste holder 40*a* again when unloading assembly 300 lowers waste holder 40*a* onto the mobile drive unit 20. For example, if mobile drive unit 20*a* is also responsible for removing waste holder 40*a* from waste station 52 after waste holder 40*a* has been emptied, mobile drive unit 20*a* may raise its docking head while unloading assembly 300 is raising or lowering waste holder 40*a* so that mobile drive unit 20*a* supports or couples to waste holder 40*a* when waste holder 40 is lowered by waste station 52. Additionally, in particular embodiments, mobile drive unit 20*a* may re-position itself to facilitate realignment with waste holder 40*a* when waste holder 40*a* is lowered. For example, mobile drive unit 20*a* may roll forward a predetermined amount to account for anticipated movement of waste holder 40*a* as waste holder 40*a* is lifted and rotated by waste station 52. After waste material 42 has been emptied from waste holder 40*a*, mobile drive unit 20*a* or another mobile drive unit 20 may then return waste holder 40*a* to the workstation 50 from which waste holder 40*a* was retrieved, another workstation 50 in need of a waste holder 40, or an area where emptied waste holders 40 wait until needed at a workstation 50.

Figure 4:
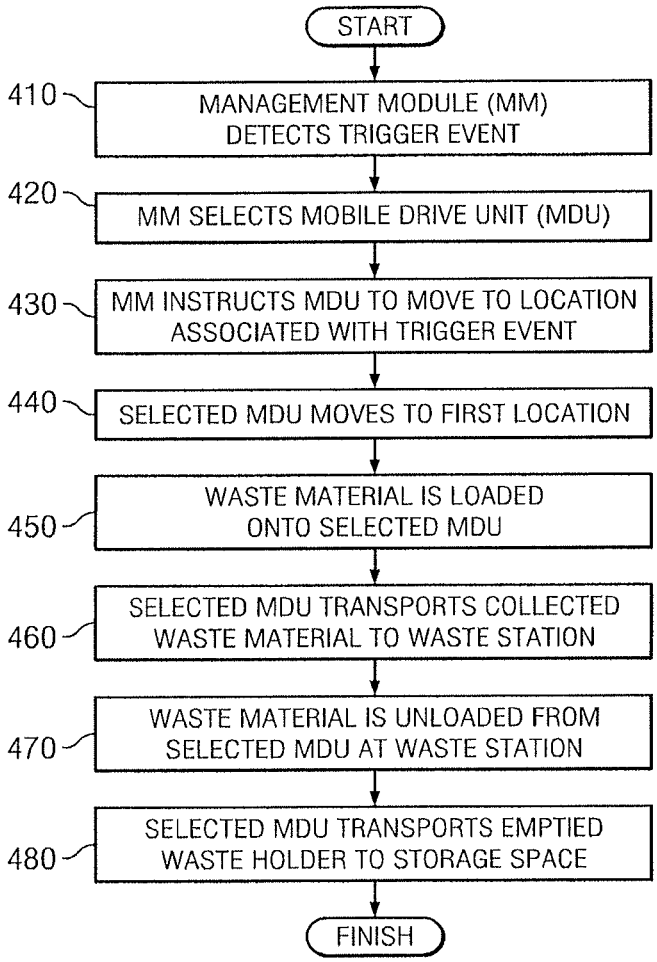
FIG. 4 is a flowchart illustrating certain aspects of an example operation of the material handling system.

FIG. 4 is a flowchart illustrating example operation of a particular embodiment of material handling system 10 in completing waste-processing tasks. The steps illustrated in FIG. 4 may be combined, modified, or deleted where appropriate, and additional steps may also be added to the flowchart. Additionally, the steps may be performed in any suitable order without departing from the scope of the invention.

Operation, in the illustrated example, begins at step 410 with management module 15 detecting an occurrence of a trigger event associated with a waste holder 40 located at a first location. The trigger event may represent any appropriate occurrence associated with waste or waste processing in material handling system 10. As one example, in particular embodiments, management module 15 initiates waste-processing tasks in response to requests (such as waste requests 82) received from operators of workstations 50 or from automated components of material handling system 10. In such embodiments, the trigger event may represent management module 15 receiving such a request.

As another example, a trigger event may represent an occurrence of an event at or change in a status of one or both of workstation 50 and waste holder 40. For example, a trigger event may represent the amount of waste at workstation 50 and/or in waste holder 40 reaching a particular predetermined threshold. Sensors (such as an analog and/or digital scale) located within workstation 50 and/or waste holder 40 may continuously and/or periodically measure the amount of waste material 42 as it accumulates. A trigger event may occur when the sensor determines that the amount of waste material 42 has reached the predetermined threshold.

As another example, a trigger event may represent the occurrence of a predetermined and/or configurable amount of work performed at workstation 50. In some embodiments, management module 15 may estimate the amount of waste material 42 produced based on a determined or estimated productivity of the worker or workstation 50. Based on the worker's or the workstation's 50 productivity, a trigger event may occur when an estimated amount of waste material 42 accumulates.

As another example, a trigger event may represent the lapse of a predetermined amount of time since the previous unloading of a particular waste holder 40 and/or the waste material 42 at workstation 50. For example, management module 15 may record when a particular waste holder 40 is unloaded and may schedule the particular waste holder 40 to be unloaded after a predetermined amount of time. The trigger event represents the end of the predetermined amount of time, and management module 15 and/or workstation 50 may initiate unloading of waste holder 40.

In particular embodiments, workstation 50 and/or waste holder 40 may communicate the occurrence of the trigger event to other components of system 10. For example, workstation 50 may transmit waste request 82 to management module 15. Workstation 50 may also transmit an alert to an operator of workstation 50, and/or may communicate the occurrence of the trigger event in any appropriate manner.

As another example, in particular embodiments, management module 15 initiates waste-processing tasks based on a schedule associated with the collection of waste material 42 from one or more locations in workspace 70. In such embodiments, management module 15 may determine a start time associated with a location (e.g., a particular workstation 50) and then detect the trigger event by detecting the occurrence of this start time. In such embodiments, the schedule may include different start times for multiple locations within workspace 70, with each start time representing a separate trigger event that prompts management module 15 to initiate waste-processing tasks involving the location or locations associated with that start time.

In response to detecting the trigger event, management module 15 initiates a waste-processing task, such as collecting waste material 42 from one or more locations associated with the trigger event and transporting the collected waste material 42 to a waste station 52. As part of initiating the relevant waste-processing task, management module 15 may select a mobile drive unit 20 to transport waste material 42 from the relevant location to waste station 52, as shown at step 420. In particular embodiments, management module 15 may detect and/or receive one or more triggering events during a period of time. Management module 15 prioritizes the order in which it initiates waste-processing tasks responsive to the one or more trigger events. Management module 15 may prioritize the order of waste-processing tasks in response to one or more trigger events based on a distance to waste station 52 from one or more locations associated with the one or more trigger events. As one example, management module 15 may initiate waste-processing tasks for the location closest to waste station 52 first, the location next closest to waste station 52 second, and the location furthest from waste station 52 last.

Management module 15 may also prioritize the order of waste-processing tasks in response to one or more trigger events based on the time of the triggering event. For example, management module 15 may prioritize waste-processing tasks in response to one or more trigger events in the order in which the trigger events are detected and/or generated. As another example, management module 15 may initiate waste-processing tasks responsive to trigger events that were detected and/or generated more than a predetermined length of time before more recent trigger events (i.e., trigger events that have not been responded to for a predetermined length of time get a higher priority).

Management module 15 may also prioritize the order of waste-processing tasks in response to one or more trigger events based on the type of waste material 42 associated with the one or more trigger events. For example, hazardous waste material 42 may be processed with a higher priority than other types of waste material 42.

Management module 15 may also prioritize the order of waste-processing tasks in response to one or more trigger events based on the type of work being done at a workstation 50 associated with the particular trigger event. For example, if work at a particular workstation 50 generates a high-volume of waste material 42, management module 15 may initiate waste-processing tasks responsive to a trigger event associated with the particular workstation 50 before trigger events associated with workstations 50 that generate lesser volumes of waste material 42. As another example, management module 15 may initiate waste-processing tasks in response to a trigger event associated with a workstation 50 that generates hazardous waste material 42 before initiating waste-processing tasks in response to a trigger event associated with a workstation 50 that generates cardboard waste material 42. At step 430, management module 15 instructs the selected mobile drive unit 20 to move to a first location associated with the detected trigger event. In particular embodiments, management module 15 may also transmit navigation information to the selected mobile drive unit 20 to facilitate its movement. For example, management module 15 may transmit the selected mobile drive unit 20 information describing at least a portion of a path from its current position to the first location. The selected mobile drive unit 20 moves to the first location at step 440.

At the first location, waste material 42 is loaded onto the selected mobile drive unit 20 in step 450. As explained above, waste material 42 may be loaded onto the selected mobile drive unit 20 by the selected mobile drive unit 20 coupling to a waste holder 40 storing the waste material 42, by the selected mobile drive unit 20 lifting the waste holder 40, or by the selected mobile drive unit 20 otherwise docking with the waste holder 40 so that the selected mobile drive unit 20 can transport the relevant waste holder 40 to waste station 52. Alternatively, an operator or automated components of material handling system 10 may load waste material 42 onto the selected mobile drive unit 20 by transferring waste material 42 from the relevant waste holder 40 onto the selected mobile drive unit 20 or a separate waste holder 40 being transported by the selected mobile drive unit 20.

After waste material 42 has been loaded onto the selected mobile drive unit 20, the selected mobile drive unit 20 transports the collected waste material 42 to a waste station 52, at step 460. The selected mobile drive unit 20 may transport the collected waste material 42 directly to waste station 52 or may move to other locations en route to waste station 52. For example, in particular embodiments, management module 15 collects waste material 42 from workstations 50 on a predetermined schedule. At a designated start time, management module 15 instructs a selected mobile drive unit 20 to visit a series of workstations 50 and waste material 42 is loaded onto the selected mobile drive unit 20 at each of these workstations 50. After collecting waste material 42 from all of these workstations 50, mobile drive unit 20 may take the collected waste material 42 to waste station 52. As noted above, management module 15 may, in particular embodiments, transmit navigation information to the selected mobile drive unit 20 to facilitate its movement. Thus, management module 15 may transmit information describing at least a portion of a path between the first destination and waste station 52, as well as any intervening destinations associated with the waste-processing tasks being completed by the selected mobile drive unit 20.

When the selected mobile drive unit 20 reaches the appropriate waste station 52, collected waste material 42 is unloaded from the selected mobile drive unit 20 at step 470. In particular embodiments, this unloading is initiated automatically by waste station 52 when management module 15, waste station 52, or other components of material handling system 10 determine that the selected mobile drive unit 20 has arrived at waste station 52. Additionally, for the purposes of this description and the claims that follow, any operations described as being initiated "automatically" are initiated, at least in part, by non-human actors or components. Although "automatically" initiated, in particular embodiments, such operations may not be initiated immediately following any preceding operations or events and may only be completed if certain conditions are satisfied. Moreover, in certain embodiments, unloading of collected waste material 42 may be initiated manually. For example, a human operator may initiate unloading due to failures of other components of material handling system 10, and/or when particular materials (such as, for example, expired drugs being unloaded into an incinerator) require monitoring during the unloading process. In general, however, the collected waste material 42 may be unloaded in any appropriate manner based on the configuration and capabilities of material handling system 10.

In particular embodiments, a waste holder 40 being transported by the selected mobile drive unit 20 is lifted from mobile drive unit 20 and the contents of this waste holder 40 are dumped in a waste bin. The waste holder 40 may then be lowered back on to the selected mobile drive unit 20, which may then transport the emptied waste holder 40 to its original location, to another workstation 50, or to any other suitable location in workspace 70. For example, in the described embodiment, the selected mobile drive unit 20, at step 480, transports the emptied waste holder 40 to a storage space where the emptied waste holder 40 waits until needed at waste station 52. Operation of material handling system 10 with respect to this particular waste-processing task may then end as shown in FIG. 4. The selected mobile drive unit 20 may then begin fulfilling other tasks, such as transporting waste material 42 from other locations to waste station 52 or transporting inventory holders 30 between locations within workspace 70.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims.

What is claimed is:

1. A material handling system, comprising:

a plurality of waste holders operable to store waste material;

a plurality of mobile drive units operable to transport waste material stored by the waste holders; and a management module operable to:

determine a rate at which waste accumulates in a waste holder, wherein the waste holder is located at a first location adjacent to a workstation;

determine, based upon the rate, a first time associated with the waste holder, the first time representing an estimated time at which a waste accumulation in the waste holder is expected to reach a threshold;

instruct, at the first time, a selected one of the plurality of mobile drive units to move to the waste holder at the first location;

receive a collection request from a user associated with the waste holder;

determine historical information associated with the user; and adjust the first time based at least upon the historical information.

2. The system of claim 1, wherein:

the historical information indicates that the waste holder was not completely filled with waste material upon receiving a previous collection request from the user; and adjust the first time comprises adding a delay to the first time.

3. The system of claim 1, wherein determining the rate at which waste accumulates in the waste holder comprises determining an amount of work done at the workstation.

4. The system of claim 1, wherein the management module is further operable to:

instruct the selected mobile drive unit to load waste material onto the mobile drive at the first location; and instruct the selected mobile drive unit to transport waste material from the first location to a waste station.

5. The system of claim 1, wherein the management module is further operable to:

determine that the selected mobile drive unit has arrived at a second location associated with unloading of waste material; and in response to determining that the selected mobile drive unit has arrived at the second location, instruct a waste station to perform a waste processing task, wherein performing the waste processing task comprises unloading the waste material from the mobile drive unit.

6. The system of claim 1, wherein determining the rate at which waste accumulates in the waste holder comprises measuring an amount of waste stored in the waste holder at each of a plurality of times.

7. A material handling system, comprising:

a plurality of waste holders operable to store waste material;

a plurality of mobile drive units operable to transport waste material stored by the waste holders; and a management module operable to:

instruct a selected one of the plurality of mobile drive units to perform a first task;

detect an occurrence of a trigger event associated with a waste holder located at a first location adjacent to a workstation;

determine that a second task associated with the trigger event has a higher priority than the first task;

assign the second task to the mobile drive unit, wherein the mobile drive unit discontinues the first task to perform the second task;

receive a collection request from a user associated with the waste holder;

determine historical information associated with the user; and adjust the first time based at least upon the historical information.

8. The system of claim 7, wherein determining that the second task associated with the trigger event has a higher priority than the first task comprises determining that a second user associated with the second task has a higher priority than a first user associated with the first task.

9. The system of claim 7, wherein determining that the second task associated with the trigger event has a higher priority than the first task comprises determining that a first type of work performed at the workstation has a higher priority than a second type of work associated with the first task.

10. The system of claim 7, wherein determining that a second task associated with the trigger event has a higher priority than the first task comprises determining that a distance between the workstation and a waste station is shorter than a distance associated with the first task.

11. The system of claim 7, wherein the management module is further operable to transmit, to the mobile drive unit, information describing at least a portion of a path between the first location and a waste station.

12. The system of claim 7, wherein management module is further operable to instruct the selected mobile drive unit to transport waste material from the first location to a waste station.

13. The system of claim 12, wherein transporting waste material from the first location to the waste station comprises:

coupling the selected mobile drive unit with the waste holder at the first location; and moving the selected mobile drive unit and the waste holder to the waste station.

14. A method for material handling, comprising:

detecting a first trigger event associated with a first waste holder, wherein the first waste holder is located at a first location adjacent to a first workstation;

after detecting the first trigger event, detecting a second trigger event associated with a second waste holder, wherein the second waste holder is located at a second location adjacent to a second workstation;

selecting a mobile drive unit from a plurality of mobile drive units;

instructing the selected mobile drive unit to move to one of the first location or the second location based on relative priority between the first and second trigger events;

instructing the selected mobile drive unit to load waste material onto the mobile drive unit at the one of the first location or the second location; and instructing the selected mobile drive unit to transport waste material from the one of the first location or the second location to a waste station, wherein the waste station is operable to perform a waste processing task.

15. The method of claim 14, further comprising:

determining that the second trigger event has a higher relative priority than the first trigger event based on a determination that a second type of waste material associated with the second trigger event has a higher priority than a first type of waste material associated with the first trigger event; and instructing the selected mobile drive unit to move to the second location.

16. The method of claim 15, wherein the second type of waste material associated with the second trigger event comprises hazardous waste material.

17. The method of claim 14, further comprising:

determining that the second trigger event has a higher relative priority than the first trigger event based on a determination that a second type of work performed at the second workstation has a higher priority than a first type of work performed at the first workstation; and instructing the selected mobile drive unit to move to the second location.

18. The method of claim 14, further comprising:

determining that the second trigger event has a higher relative priority than the first trigger event based on a determination that the second workstation is closer in distance to the waste station than the first workstation; and instructing the selected mobile drive unit to move to the second location.

19. The method of claim 14, further comprising:

after the selected mobile drive unit transports the waste material to the waste station, instructing the selected mobile drive unit to move to a third location associated with an inventory holder;

instructing the selected mobile drive unit to dock with the inventory holder at the third location; and instructing the selected mobile drive unit to move the inventory holder to a fourth location.

* * * * *